US007481618B2

(12) United States Patent
Booth et al.

(10) Patent No.: US 7,481,618 B2
(45) Date of Patent: Jan. 27, 2009

(54) MOUNTING ARRANGEMENT

(75) Inventors: Stephen J. Booth, Allestree (GB); Alison J. McMillan, Uttoxeter (GB)

(73) Assignee: Rolls-Royce plc, London (GB)

( * ) Notice: Subject to any disclaimer, the term of this patent is extended or adjusted under 35 U.S.C. 154(b) by 130 days.

(21) Appl. No.: 11/312,404

(22) Filed: Dec. 21, 2005

(65) Prior Publication Data

US 2007/0140857 A1 Jun. 21, 2007

(51) Int. Cl.
*F01D 9/00* (2006.01)

(52) U.S. Cl. ..... 415/191; 415/209.3; 415/211.2

(58) Field of Classification Search ..... 415/200, 415/209.3, 213.1, 191, 211.2
See application file for complete search history.

(56) References Cited

U.S. PATENT DOCUMENTS 3,511,577 A 5/1970 Karstensen
4,300,868 A 11/1981 Wilkinson
4,384,822 A 5/1983 Schweikl
5,584,654 A 12/1996 Schaefer
5,846,050 A * 12/1998 Schilling ..... 415/135
6,296,443 B1 * 10/2001 Newman et al. ..... 415/209.2
6,409,472 B1 * 6/2002 McMahon et al. ..... 415/189

FOREIGN PATENT DOCUMENTS

DE 102004006706 A 2/2004
EP 0 526 058 A 2/1993

* cited by examiner

*Primary Examiner*—Ninh H Nguyen
(74) *Attorney, Agent, or Firm*—W. Warren Taltavull; Manelli Denison & Selter PLLC

(57) ABSTRACT

Appropriate location of components such as vanes in gas turbine engines is important. These components are located between tangs held in interference engagement. There are four relatively rigid mounting points constituted by the tangs engaging respective opposed slots in a casing or a mounting ring. Only three point limitation with respect to displacement and rotation is adequate so provision of a fourth locator causes unnecessary constraint. A relatively resilient or compliant locator means it is possible to reduce the amount of constraint upon the component mounting whilst the other locators are adequate for positioning of the component.

19 Claims, 3 Drawing Sheets

PRIOR ART

MOUNTING ARRANGEMENT

FIELD OF THE INVENTION

The present invention relates to mounting arrangements and more particularly to mounting arrangements utilised to secure vanes in a gas turbine engine.

BACKGROUND OF THE INVENTION

It is a requirement in a large number of situations to provide a mounting whereby a component is resiliently fixed despite being subject to loads as a result of thermal cycling or mechanical pressures. Ideally, these loads should be accommodated in the form of relative slippage to avoid overstressing of the component.

FIG. 1 illustrates a typical prior mounting arrangement of a vane 1 secured between an inner mounting ring 2 and an outer casing 3. The vane 1 is secured to an inner platform 4 and an outer platform 5 from which a tang arm 6 extends to a tang 7 which is engaged in an interference fit with a slot or groove 8 formed in the respective ring 2 or casing 3. This engagement may be an interference or close clearance fit. Although illustrated with respect to a tang mounting arrangement it will be appreciated that other mounting arrangements and fixing mechanisms could be used. The vane 1 may typically be formed from an organic matrix composite aerofoil material. The vane 1 may be held in place in a bypass, fan or compressor module of a gas turbine engine. Alternatively, the vane 1 could be formed from relatively high temperature materials which would allow operation in the turbine stages of a gas turbine engine.

The arrangement depicted in FIG. 1 as indicated is typically used to anchor a vane in place in forward and rearward positions through insertion of tangs into circumferential slots in the casing 3 and inner ring 2. In such circumstances as can be seen there is a four point fixing arrangement constituted by the respective tangs 7 in the slots or grooves. There is a semi freedom for the respective tang 7 to slip, subject to any clearance gap and any interference friction within their respective slot or groove 8 in order to provide a mechanism for damping any vibration in the vane which may be induced by periodic variations in gas stream flow, such as due to blading, or structural vibrations transmitted through the inner ring 2 or casing 3. It will also be understood that the tang 7 may also provide a gas seal when required.

A particular problem relates to the fact that four-point fixing with the arrangement as depicted in FIG. 1 can cause over-constraint upon the vane 1. It is accepted that a structure needs three distinct displacement and three distinct rotation constraints in order to provide positional retention. In practice, there are also design clearances and thermal growth effects, etc., to consider, but it is broadly accepted that a fourth tang is largely redundant and, as indicated, provides over-constraint. In such situations vibration, thermal growth or direct loading of the component, that is to say the vane 1, can result in stress or strain distributions which give rise to constraint forces at the respective fixing points. With four fixing points these constraint forces are accentuated.

FIG. 2 illustrates a typical prior mounting arrangement whereby a vane 21 has a platform 11 which is secured to a tang element 27 by an adhesive layer 12. Such an arrangement is relatively easy to manufacture whereby the vane 21 and platform 11 can be formed and secured through the adhesive 12 to an appropriately shaped tang element member 27 with limited machining and other manufacturing processes necessary. Unfortunately, the constraint forces tend to limit the load potential of the arrangement as depicted in FIG. 1. It will be understood that the bonding provided by the adhesive layer 12 between the element 27 and platform 11 may be subject to straining forces or potentially more importantly the area, known as the tang arm, connecting the tang end of the element 27 with the remainder of that element will be subject to such loading. In such circumstances there is a possibility of peel failure between the element 27 about the adhesive layer 12, or failure of the tang arm.

SUMMARY OF THE INVENTION

In accordance with a first aspect of the invention there is provided a mounting arrangement for a vane for a gas turbine engine, the arrangement comprising four resilient locators arranged in use to substantially retain the component in position, the arrangement characterised in that one of the resilient locators is more resilient than the other locators so that this more resilient locator does not constrain the position of the arrangement and introduce distortion.

Preferably, the locators are tangs laterally extending from the component in order to provide location, and are secured in respective slots. The tangs may allow a degree of relative sliding movement.

The locators may be interference locators. The locators may be clearance locators giving space for thermal growth.

Preferably, the locators are arranged in pairs, the locators of each pair being laterally opposed to each other.

In a particular embodiment of the invention, the more resilient locator may comprise a narrower section segment for reduced interference clearance compared to the other locators within the arrangement.

In a second particular embodiment, the more resilient locator may comprise a locator portion having a greater unsupported length in comparison to the other locators whereby the locator portion has less resistance to deflection.

In a third particular embodiment the more resilient locator may be formed as a spring structure.

In a fourth particular embodiment the more resilient locator may incorporate cut-outs for increased relative flexibility compared to the other locators.

The more resilient locator may incorporate a curved joint possessing varying resistance to deformation. In a particular preferred embodiment, the curved joint may lead to a tang of a form as described above, in the eleventh paragraph.

The more resilient locator may be formed from a less rigid material than the other locators.

The other locators may provide three distinct displacement and three rotational constraints upon the vane in use.

The mounting arrangement may be formed from an organic matrix composite material.

In accordance with a second aspect of the invention, an engine, incorporating a casing and a mounting ring arranged to accommodate a vane therebetween with locators to retain component position, is characterised in that one locator is relatively resilient compared to the other locators to allow for load distortions imposed upon the vane.

In a preferred embodiment of this aspect of the invention the locators may comprise tangs arranged to be accommodated within slots or grooves of the respective casing and/or mounting ring. Each slot or groove may be circumferential about the respective casing or mounting ring. Each locator may allow a degree of sliding relative to the respective casing or mounting ring.

BRIEF DESCRIPTION OF THE DRAWINGS

Embodiments of the present invention will now be described by way of example and with reference to the accompanying drawings in which.

DETAILED DESCRIPTION OF THE INVENTION

Figure 1:
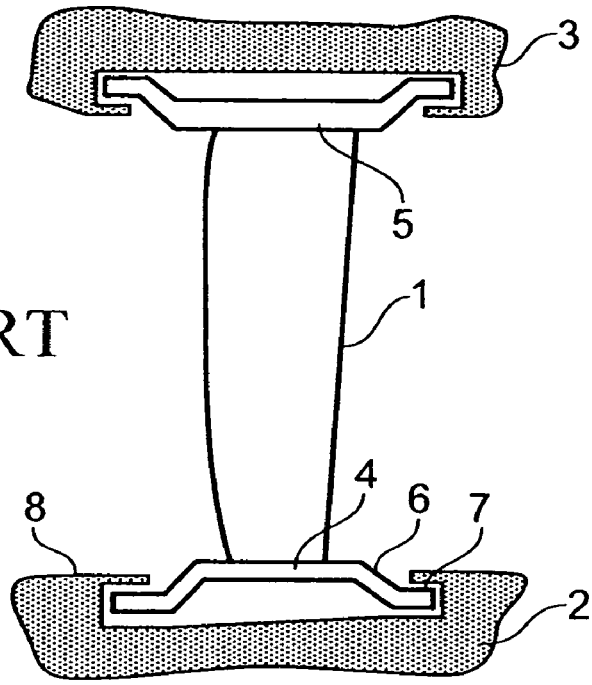
FIG. 1 is a schematic front view of a Prior mounting arrangement of a vane secured between an inner mounting ring and an outer casing.

In order to optimise a mounting arrangement utilised for such components as guide vanes within a gas turbine engine, it is important to ensure good positional location as well as adaptability for varying loads created by vibration or blading upon those components. Clearly, it is possible to provide mountings which include deformable or suspensive features to allow for load deformations as a result of vibration. Such suspensive arrangements all tend to be on one end or side of the mounting arrangement and so necessitate a compromise with respect to positional location.

As indicated above, it is generally accepted that three points of location in order to provide displacement positioning and rotational resistance are adequate for component location within a housing. Any further locator significantly constrains the component such that vibrational or other loadings can present significant stresses and strains upon the component leading to cracking and other failure.

Captive type locators in the form of an entrant member, such as tangs, held within opposed grooves are well known and depend upon interference for location. Thus, with respect to gas turbine engines it is known to provide mountings for a guide vane whereby platforms at either end are associated with tang members which extend into slots or grooves in respective mounting rings and outer casings (see FIG. 1). Inherently there is a degree of pinch such that although there may be an interference location between the tangs and the slots or grooves under load slide it is possible. Nevertheless, clearly by providing opposed tangs on either side of the platform the result is that there are four associated locators, that is to say the tangs presenting constraint upon the vane and its platform in generally opposed pairs. However, all that is required is three locators to ensure vane component position. It will be appreciated that there are also possible requirements with respect to friction damping and gas sealing, but nevertheless over-constraint leads to limitations upon mechanical performance.

In view of the above, within the constraints of achieving adequate and secure location in accordance with the present invention one of the locators is configured as a resilient locator. Thus, it is configured to provide a reduced or relatively lower interference or other fixation of location in comparison with the other locators. In such circumstances in the example given in FIG. 1, one of the four fixing points, that is to say one of the tangs extending into the mounting ring or casing slot, is rendered more compliant by being resilient. Normally in the example given, as the inner platform of the vane is generally much smaller than the outer it is likely that one its inner locators will be chosen as that which is more resilient and compliant under loading. Generally, the stiffness of the region between the vane platform and the locator is reduced so that this particular locator is more compliant. As indicated, generally tangs will enter slots in order to provide the locator fixings and so it is one of these tangs which will be rendered more compliant. There are a number of approaches as outlined by the embodiments below with respect to achieving this resilient compliance in comparison with the other locators providing three point location of a component such as a vane in accordance with the present invention.

Figure 3:
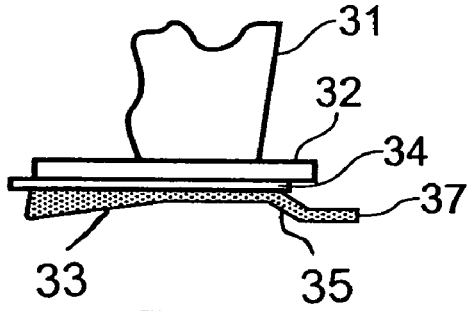
Fig. 3 PRIOR ART
FIG. 3 is a schematic part front view of an interference locator in accordance with an arrangement of the present invention.

In accordance with a first embodiment of the invention as depicted in FIG. 3, a tang 37 as a more compliant locator will be arranged to have a thinner cross-section and so beam stiffness in comparison with the other more rigidly secured locator tangs utilised for positioning a vane 31. A platform 32 of the vane 31 is secured to a tang member 33 through an adhesive layer 34 in a conventional manner. However, the tang member 33 as shown has one tang 37 which is of a narrower cross-section in comparison with other tang locators (not shown). Thus, the member 33 generally thickens at a portion 35 away from the compliant or resilient locator tang 37 in order to provide the thicker locator tangs (not shown) which are engaged with typically slots or grooves as described previously with regard to FIG. 1 in order to provide location of the component vane 31 in use. It is known that beam stiffness is proportional to thickness in a ratio of the power of three so a relatively small reduction in the thickness of the resilient locator tang 37 provides a relatively high variation in the compliance or resilience of the tang 37 in comparison with other locators (not shown). Thus, the minimum number of locators are utilised in order to ensure component vane 31 position and so limit constraint upon that component 31 with respect to accommodating vibration or other loading upon the component vane 31 which may cause premature failure or mechanical ageing particularly about junctions between the vane 31 and the platform 32/tang member 33.

As indicated previously, generally the locators utilised for locating a component vane 31 may be of an interference type where the tangs enter slots or grooves such that there is a close clearance fit between the entrant tang and the slot or groove. By the embodiment depicted in FIG. 3, the resilient locator tang 37 has a narrower cross-section and therefore the ability of the tang 37 to deform in compliance with loadings is enhanced in comparison with the other locators such that there are only three robust and substantially rigid locators. Thus, best location of the vane component 31 is achieved with adequate surety with respect to position, but with a limitation with respect to constriction which may result in stresses and strains being applied to the arrangement due to the more compliant nature of the resilient locator tang 37.

Figure 4:
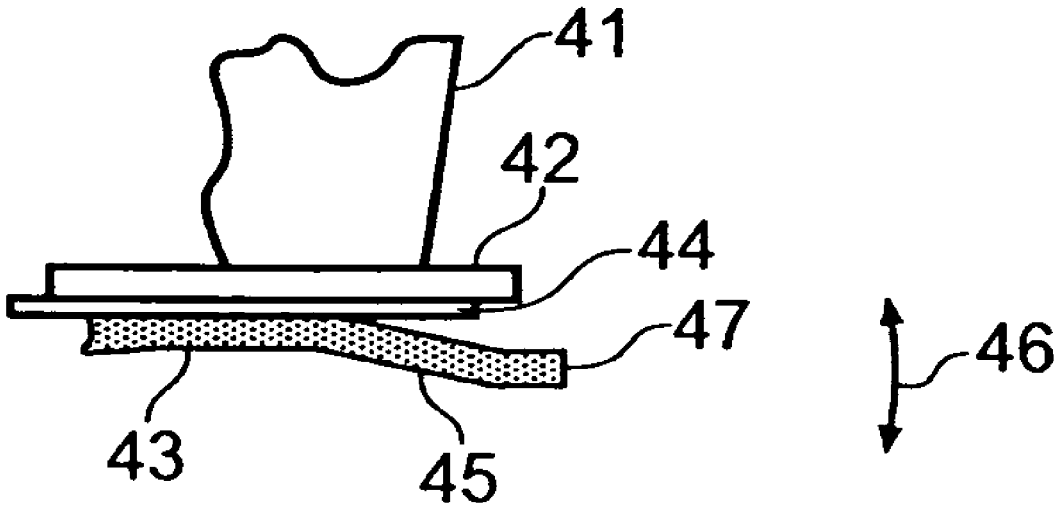
FIG. 4 is a schematic part front view of a second embodiment of an interference locator in accordance with the present invention.

FIG. 4 illustrates a second embodiment of a locator in accordance with the present invention in which a tang 47 is presented relative to a component vane 41 by attachment to a platform 42 through an adhesive layer 44. Generally, the locator tang 47 is secured to a tang member 43 which is then secured to the platform 42 through the adhesive 44. In order to create relative compliance with respect to the tang 47 in comparison with other locators (not shown) the tang 47 is secured with a greater unsupported length than with previous tangs (see FIGS. 1 to 3). In such circumstances, a tang arm 45 extends with a longer and more oblique angle to present the tang 47. In such circumstances the tang 47 may be deflected for compliance in the directions of arrowheads 46 under load deformation.

Figure 2:
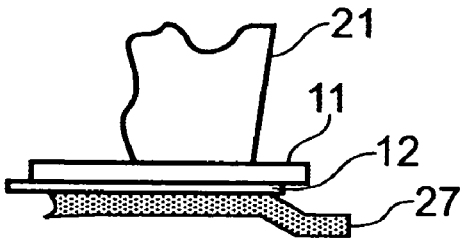
FIG. 2 is a schematic part front view of a prior mounting arrangement whereby a vane has a platform secured to a tang element by an adhesive layer.

As described previously, in a mounting arrangement similar to that depicted in FIG. 1, three of the locators may be of a conventional tang within a slot groove, whilst a fourth resilient locator may be as depicted in FIG. 4 to allow adjustments as a result of vibrational and other loadings presented upon the component vane 41. In such circumstances the component vane 41 is appropriately located and positioned with the rigid three point locator requirements as described previously with the fourth locator provided by the resilient arrangement of a cantilevered tang arm 45 depicted in FIG. 4 which has a greater unsupported length and therefore susceptibility to deformation and so is less rigid for the purposes of engagement for location.

The arrangement depicted in FIG. 4 may also allow the spacing between the vane 41 and any neighbouring vanes or blades within a gas turbine engine to be reduced, and so axial length with regard to the engine. However, it will be understood that the opposing locator as indicated previously will generally be of the more robust rigid interference type necessary to provide three point positioning of the component vane 41. The outer casing provides a greater potential for such close spacing of the vanes, whereas with regard to the inner mounting ring of a much smaller circumference, such close association with adequate mounting of the vane may be more difficult. Essentially, via the unsupported tang arm 45, it is possible for that tang 47 to engage its slot in a more staggered configuration, with the next upstream normal locator then allowed to impinge to a far greater extent upon the rear side of the platform 42 than with previous arrangements. Such staggering allows a consequent closer spacing between the vane component 41 and that of an adjacent blade or vane stage (not shown) in a gas turbine engine.

Figure 5:
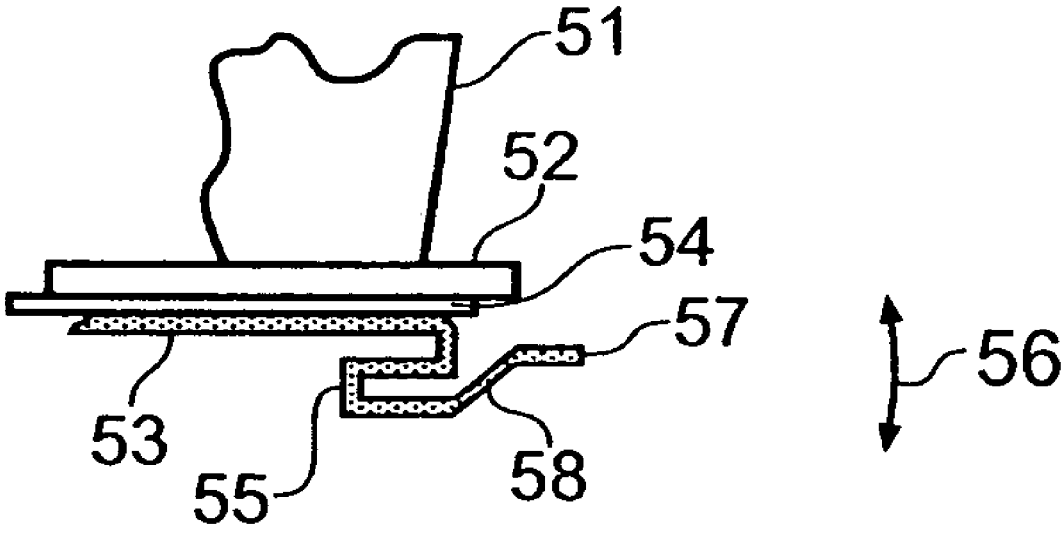
FIG. 5 is a schematic part front view of a third interference locator in accordance with the present invention.

It will be understood from the above that a principal objective with respect to the present invention is to provide resilience or compliance with regard to the one locator in comparison with the other locators for the component in the arrangement. FIG. 5 illustrates a further manner by which such compliance can be achieved. Thus, a vane component 51 has a platform 52 secured to a tang member 53 by an adhesive layer 54. The tang member 53 creates a tang arm 55 which has a relatively soft spring nature through creating a folded back Z or S configuration in order that a tang 57 is presented in use to a slot or groove as described previously with respect to FIG. 1. In such circumstances, the tang locator 57 can be more readily displaced in the direction of arrowheads 56 than other locators as described previously of a conventional nature for presentation and location of the component vane 51. Creation of the spring configuration in the tang arm 55 introduces a significant manufacturing step in provision of the tang member 53. However, as described previously, these tang members 33, 43, 53 and subsequent tang members described below are generally formed separately and secured to the platforms 52 through the adhesive layers as described. In such circumstances, forming the tang members 53 can be more readily achieved than through casting as part of the vane component 51/platform 52 combination.

It will be understood by varying the thickness of the tang arm 55 that the degree of spring provided and therefore resilience/compliance provided in the tang 57 can be adjusted as required for operational performance in use. Similarly, the relative positioning of the tang arm 55 may be adjusted through the final section 58 in terms of angle and length to again adjust the compliance of the tang 57 in its receptive slot or groove.

Figure 6:
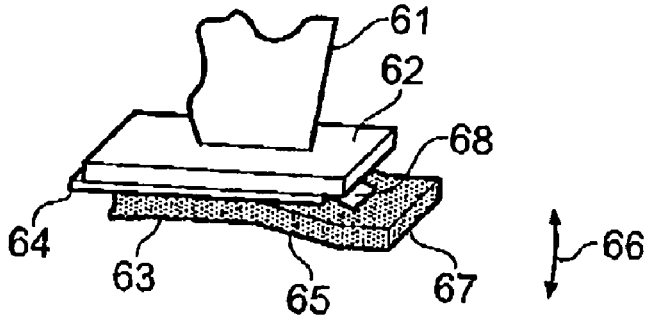
FIG. 6 is a schematic part front view of a fourth interference locator in accordance with the present invention.

As indicated above, generally there may also be a requirement with respect to locators to create some form of gas seal either separately or in association with other assemblies. However, where such sealing is not a requirement, the necessary resilience or compliance in the resilient locator can be achieved through provision of cut out windows in a tang arm. FIG. 6 illustrates a vane component 61 secured upon a platform 62 via an adhesive layer to a tang member 63. A tang arm 65 is incorporated in the tang member 63 between the part secured through the adhesive 64 and an entrant locator tang 67 which in use is located within a slot or groove. The tang arm 65 incorporates cut-out windows 68 which render the tang 67 more compliant to allow deformations in the direction of arrowheads 66 in use within the slot accommodating the tang 67. Thus, as indicated previously, the component vane 61 can be adequately located by three other relatively rigid locators in accordance with conventional three point displacement and rotation resistance, whilst by means of a locator as depicted in FIG. 6, no further constriction is placed upon adjustment of the mounting arrangement in order to accommodate loadings upon the component vane 61 as a result of vibration or blading, etc. It will be appreciated that the windows 68 will generally be distributed to achieve the desired enhanced flexibility for compliance and resilience in comparison with the other more rigid locators (not shown). Furthermore, the windows 68 may as indicated simply be of an rectangular shape or themselves be machined, particularly in relation to orientation or shape, to facilitate deformation either symmetrically or asymmetrically as required for best resilience and compliance response in use. Although the windows can be a variety of shapes normally the geometry would be chosen to avoid corners, as these would be stress raisers.

As can be seen in the previous figures, normally a component is secured upon a platform and this platform is then secured to a locator or locators as appropriate. In such circumstances, loads are transferred through the platform to the respective locators, typically as depicted locator tangs entering slots or grooves in respective casing or mounting rings. In a sixth embodiment of the present invention, the platform may be arranged whereby the vane component is variably secured across the platform. Thus, the joint to secure the vane to the platform is wavy with respect to its resilience as a locator. In such circumstances effectively a further locator is provided in the form of a joint across the platform. By creation of a specifically configured curved joint for securing the vane across the platform, it will be understood that this locator in terms of the joint will be rendered more complaint than the tangs entering their slots or grooves. In such circumstances, the curved joint for locating the vane may minimise peel loading upon the joint between the vane component and the platform under given load conditions whilst the other locators will continue to ensure appropriate presentation of the vane component in use.

Figure 7:
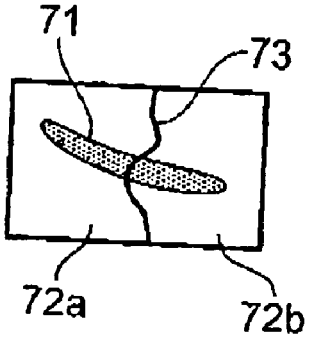
FIG. 7 is a schematic part plan view of a fifth embodiment of an interference locator in accordance with the present invention.

FIG. 7 illustrates this fifth embodiment of the present invention. Thus, a vane component 71 is presented across the platform 72 and secured by a locator depicted as a curved joint 73 between them. In such circumstances, the curved joint 73 will be determined to optimise operational performance in order to balance any over-constraint loads caused by conventional interference tang locators in slot mounting arrangements under particular loading conditions or excitation frequencies presented to the vane 71. In such circumstances, it can be considered that the joint 73 acts as a normal locator for operational performance until such particular loading conditions or excitation frequencies are presented to the vane 71 whereupon due to the nature of the curve of the joint, variable slippage occurs for the desired resilient compliance as described previously to accommodate such loadings.

Alternatively, region 72*a* could extend below region 72*b*, and form a tang arm as shown in FIG. 4, but where the joint line is now curved.

Figure 8:
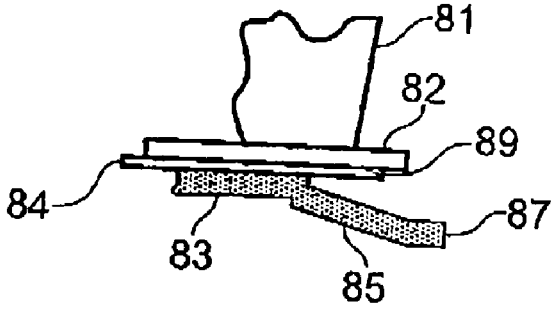
FIG. 8 is a schematic part front view of a sixth embodiment of an interference locator in accordance with the present invention.

FIG. 8 illustrates a sixth embodiment of the invention. As in the previous embodiments, a vane component 81 is secured upon a platform 82 via an adhesive layer 84 to a tang member 83. A tang arm 85 is incorporated in the tang member 83 between the part secured through the adhesive 84 and an entrant locator tang 87 which in use is located within a slot or groove. In this embodiment, a step 89 is provided between the tang arm 85 and the part of the tang member 83 secured through the adhesive 84. By suitable choice of the size of the step 89, and of the thickness of the tang arm 83 at that position, the compliance of the tang arm 85 may be altered to achieve the desired flexibility, as described for the previous embodiments. The presence of the step 89 may also reduce the tendency for the adhesive bond between the tang member 83 and the adhesive 84 to break at the point where the two separate.

Figure 9:
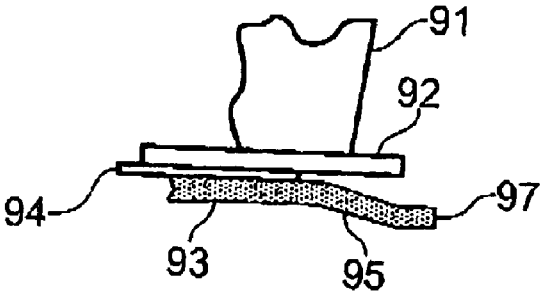
FIG. 9 is a schematic part front view of a seventh embodiment of an interference locator in accordance with the present invention.

FIG. 9 shows a further embodiment of the invention. This embodiment is generally similar to that shown in FIG. 4, but the adhesive 94 terminates further along the platform 92, away from the junction between the tang member 93 and the tang arm 95. Because the adhesive bond is over a shorter length of the tang arm 93, the locator tang 97 will tend to have a higher flexibility than an otherwise equivalent arrangement, for example as shown in FIG. 4. Also, as in the previous embodiment, this configuration may reduce the tendency for the adhesive bond between the tang member 83 and the adhesive 84 to break at the point where the two separate.

In addition to the embodiments described above, it will be appreciated that in a further alternative embodiment or refinement, either achieved separately or as a cumulative modification with respect to these embodiments, the resilient locator for the component may be simply formed from a material having a different, that is to say less rigid, nature than the other locators utilised with respect to providing location and positioning of the component in use. Thus, a tang arm or tang entrant in a slot may be formed from a material having a lower Young's modulus than for the other locators, or where the locators are formed from composite materials the outer layers of the composite may be formed from such lower Young's modulus materials in order to create a less rigid effect and therefore compliance in accordance with the present invention.

Normally, the locators in the form of tangs located within slots in accordance with the present invention would be formed from organic matrix composites in order to achieve the desired effects with respect to altering the compliance of one particular resilient locator in comparison with the other locators. However, where suitable materials are available, it may be possible to utilise metallic materials with an appropriate local thinning of the locator in the form of a tang arm at the point where it joins the platform such that the tang end is therefore rendered more compliant in comparison with other locators in which there is no such localised thinning. Such thinning may be achieved through creation of a rolled sheet with a bulge in the roller to give a local pocket in the eventually formed platform or alternatively such localised thinning may be achieved through masked chemical etching. Furthermore, it may be possible to achieve localised thinning of the platform around the periphery of the component vane formed on the platform in order to create again a suspensive spring effect.

The invention claimed is:

1. A mounting arrangement for a vane for a gas turbine engine, the arrangement comprising a casing and four resilient locators arranged in use to substantially retain a component in position, the arrangement characterised in that one of the resilient locators is more resilient than the other locators so that this more resilient locator does not constrain the position of the arrangement and introduce distortion wherein each locator is a tang laterally extending from the component in order to provide location.

2. An arrangement as claimed in claim 1 wherein the tangs are secured in respective slots.

3. An arrangement as claimed in claim 1 wherein the tangs allow the casing a degree of relative sliding movement.

4. An arrangement as claimed in claim 1 wherein the locators are interference locators.

5. An arrangement as claimed in claim 1 wherein the locators are clearance locators giving space for thermal growth.

6. An arrangement as claimed in claim 1 wherein the locators are arranged in pairs, the locators of each pair being laterally opposed to each other.

7. An arrangement as claimed in claim 1 wherein the more resilient locator comprises a narrower section segment for reduced interference clearance compared to the other locators within the arrangement.

8. An arrangement as claimed in claim 1 wherein the more resilient locator comprises a locator portion having a greater unsupported length in comparison to the other locators whereby the locator portion has less resistance to deflection.

9. An arrangement as claimed in claim 1 wherein the more resilient locator is formed as a spring structure.

10. An arrangement as claimed in claim 1 wherein the more resilient locator incorporates cut-outs for increased relative flexibility compared to the other locators.

11. An arrangement as claimed in claim 1 wherein the more resilient locator incorporates a curved joint possessing varying resistance to deformation.

12. An arrangement as claimed in claim 11 wherein the curved joint leads to a tang comprising a narrower section segment for reduced interference clearance.

13. An arrangement as claimed in claim 1 wherein the other locators provide three distinct displacement and three rotational constraints upon the vane in use.

14. An arrangement as claimed in claim 1 wherein the mounting arrangement is formed from an organic matrix composite material.

15. A mounting arrangement for a vane for a gas turbine engine, the arrangement comprising four resilient locators arranged in use to substantially retain a component in position, the arrangement characterised in that one of the resilient locators is more resilient than the other locators so that this more resilient locator does not constrain the position of the arrangement and introduce distortion wherein the more resilient locator is formed from a less rigid material than the other locators.

16. An engine incorporating a casing and a mounting ring arranged to accommodate a vane therebetween with locators to retain component position; the engine characterised in that one locator is relatively resilient compared to the other locators to allow for load distortions imposed upon the vane wherein each locator is a tang laterally extending from the vane in order to provide location.

17. An engine as claimed in claim 16 wherein the locators comprise tangs arranged to be accommodated within slots or grooves of the respective casing and/or mounting ring.

18. An engine as claimed in claim 17 wherein each slot or groove is circumferential about the respective casing or mounting ring.

19. An engine as claimed in claim 16 wherein each locator allows a degree of sliding relative to the respective casing or mounting ring.

* * * * *